United States Patent [19]

Mutou

[11] Patent Number: 4,569,111

[45] Date of Patent: Feb. 11, 1986

[54] APPARATUS FOR JOINTING PLATE MATERIALS

[75] Inventor: Yoshihiro Mutou, Konan, Japan

[73] Assignee: Tokyo Shibaura Denki Kabushiki Kaisha, Japan

[21] Appl. No.: 539,635

[22] Filed: Oct. 7, 1983

Related U.S. Application Data

[63] Continuation of Ser. No. 234,334, Feb. 13, 1981, abandoned.

[30] Foreign Application Priority Data

Feb. 13, 1981 [JP] Japan ..... 55-16352

[51] Int. Cl.[4] ..... B23Q 1/00; B23Q 3/00; B23Q 7/04

[52] U.S. Cl. ..... 29/283.5; 29/509; 29/522 R; 72/465

[58] Field of Search ..... 29/243.5, 243.52, 283.5, 29/509, 522 R; 413/4, 114; 72/391, 399, 465; 279/41 R

[56] References Cited

U.S. PATENT DOCUMENTS

| | | | |
|---|---|---|---|
| 368,159 | 8/1887 | Mussinan, Jr. | 279/41 R |
| 1,313,284 | 8/1919 | Foster | 72/465 |
| 2,811,880 | 11/1957 | Williams | 29/521 X |
| 2,829,899 | 4/1958 | Drew et al. | 279/41 R |
| 3,122,948 | 3/1964 | Baugh et al. | 72/391 |
| 3,404,648 | 10/1968 | Rosbottom | 29/509 X |
| 3,451,367 | 6/1969 | Henrickson | 413/14 |
| 3,478,564 | 11/1969 | Hurd | 72/391 |
| 3,579,809 | 5/1971 | Wolf | 29/509 |
| 3,726,000 | 4/1973 | Hafner | 29/521 X |
| 3,771,216 | 11/1973 | Johnson | 29/509 |
| 3,837,661 | 9/1974 | Phillippi | 279/41 R X |
| 4,306,511 | 12/1981 | Ashby | 29/521 |

FOREIGN PATENT DOCUMENTS

| | | | |
|---|---|---|---|
| 21758 | 6/1977 | Japan . | |
| 31828 | 8/1977 | Japan . | |
| 333418 | 8/1930 | United Kingdom | 29/521 |
| 2025278 | 1/1980 | United Kingdom | 279/41 R |

*Primary Examiner*—Charlie T. Moon

*Attorney, Agent, or Firm*—Cushman, Darby & Cushman

[57] ABSTRACT

An apparatus for jointing plate materials comprises a punch, a die having a die hole for drawing a plurality of overlapping materials in cooperation with the punch. The peripheral wall of the die hole consist of a plurality of independent sections. The apparatus further comprises a base section for extending a drawn part of the materials along the radial direction of the punch in cooperation with the punch, and splits formed on the die for separating the sections from one another along the radial direction of the punch.

2 Claims, 9 Drawing Figures

APPARATUS FOR JOINTING PLATE MATERIALS

This is a continuation of application Ser. No. 234,334, filed Feb. 13, 1981 now abandoned.

BACKGROUND AND SUMMARY OF THE PRESENT INVENTION

This invention relates to a method for jointing a plurality of overlapping plate materials to one another and an apparatus used to effect such method.

In jointing or coupling a plurality of overlapping plate materials to one another, there have hitherto been used rivets, combinations of bolts and nuts, or welding. When using the rivets or the combinations of bolts and nuts, it is necessary to perform riveting or bolt-nut mating after forming through holes for the rivets or bolts in the plate materials. This means that the jointing requires a lot of time, comparatively. Further, the formation of the through holes will reduce the mechanical strength of the plate materials. If the plate materials are covered with a thin film such as a coating film, moreover, the film will be damaged at the peripheral edge portions of the through holes. If the film is a coating film, the plate materials will rust, starting from the damaged portions of the film. The kinds of plate materials which can be joined together by welding are limited. Further, the welding method requires a special equipment which uses gas or high-voltage current.

The object of this invention is to provide a method for jointing plate materials capable of reducing the time required for joining without reducing the mechanical strength of the plate materials or damaging films on the materials and without limiting the kinds of applicable materials or requiring any special equipment, neither, and an apparatus therefor.

BRIEF DESCRIPTION OF THE ACCOMPANYING DRAWINGS

This invention can be more fully understood from the following detailed description when taken in conjunction with the accompanying drawings, in which.

DETAILED DESCRIPTION OF THE PREFERRED EXEMPLARY EMBODIMENTS

Figure 1:
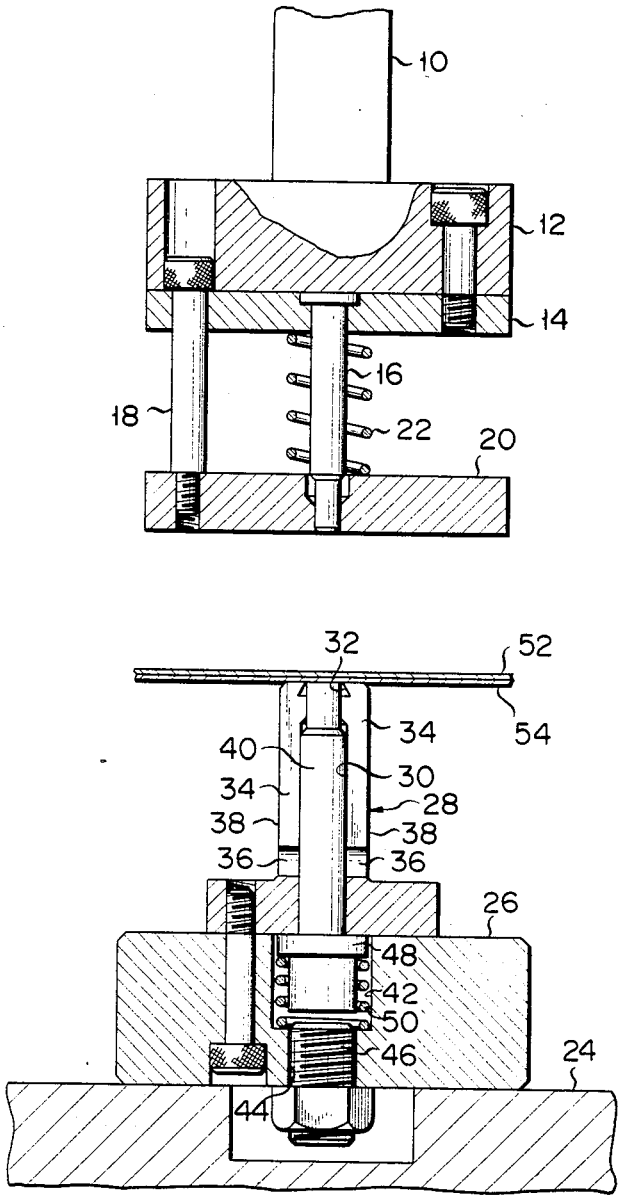
FIG. 1 is a partial sectional view of an embodiment of this invention.

The apparatus according to an embodiment of this invention, as shown in FIG. 1, is provided with a punch holder 12 which is fixed to a ram 10 of a press. A punch frame 14 is fixed to the under surface of the punch holder 12. The punch frame 14 fixes a punch 16 to the punch holder 12.

As shown in FIG. 1, a guide pin 18 is inserted in the punch frame 14, and is fixedly fitted with a presser plate 20 in which the tip of the punch 16 is inserted. The presser plate 20 can move along the vertical direction of FIG. 1 by the action of the guide pin 18. A compression coil spring 22 is wound round the punch 16, and is held between the punch frame 14 and the presser plate 20 so as to urge the presser plate 20 to its lowermost position as shown in FIG. 1.

A bolster 26 is mounted on a bed 24 of the press, as shown in FIG. 1. A die 28 is fixed on the top of the bolster 26. A hole 30 with a circular cross section vertically extends through the die 28. The upper end portion 32 of the inner peripheral surface of the hole 30 is tapered so that its diameter is gradually reduced toward the upper end face of the die 28.

Figure 2:
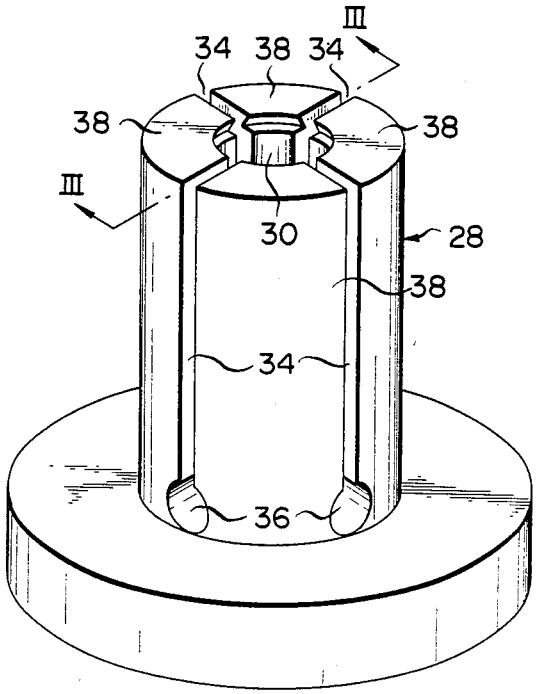
FIG. 2 is a perspective view of a die shown in FIG. 1.
Figure 3:
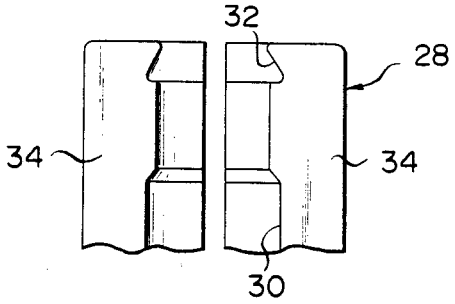
FIG. 3 is a front view showing the upper end portion of the die as taken along line III—III of FIG. 1.

As shown in detail in FIG. 2, a plurality of vertically extending splits 34 are formed in the die 28 at regular intervals along the circumferential direction of the die 28. In this embodiment, the splits 34 are four in number. The upper ends of the splits 34 reach the top end face of the die 28, and a circular hole 36 is formed at the bottom end of each split 34. The circular hole 36 extends from the outer peripheral surface of the die 28 to the hole 30. The die 28 is divided into four sections 38 by the splits 34, and these four sections 38 can be outwardly elastically spread along the radial direction around the lower ends of their corresponding splits 34. The circular holes 36 function to diffuse stress concentrated on the lower ends of the splits 34 when the four sections 38 are spread, thereby facilitating the elastic spreading and restoration of the four sections 38 of the die 28.

As shown in FIG. 1, a base section 40 is inserted in the hole 30 of the die 28 so as to be able to move along the vertical direction in the hole 30. The lower end of the shaft like main body of the base section 40 is inserted in a hole 42 defined in the bolster 26. Formed on the bottom portion of the hole 42 is a female screw which mates with a height adjusting screw 46. An outward flange 48 is formed in the vicinity of the lower end of the shaft like main body of the base section 40. A compression coil spring 50 is fitted in the hole 42 of the bolster 26 so as to abut on the under surface of the outward flange 48 of the base section 40 and the bottom of the hole 42. The base section 40 is always urged to move upward by the elastic force of the compression coil spring 50, thereby causing the top of the outward flange 48 to abut on the under surface of the die 28. In this situation, the top end face of the base section 40 is flush with the top end face of the die 28. And the position of the base section 40 in the hole 30 at above described situation is called a first position. The top end face of the screw 46 faces the bottom end face of the base section 40. The distance between the top end face of the screw 46 and the bottom end face of the base section can be varied by turning the screw 46 in either direction. Namely, the distance of the fall of the base section 40, when the base section 40 is lowered against the elastic force of the compression coil spring 50, can be adjusted.

Now there will be described the operation of the embodiment of the above-mentioned construction.

Figure 4:
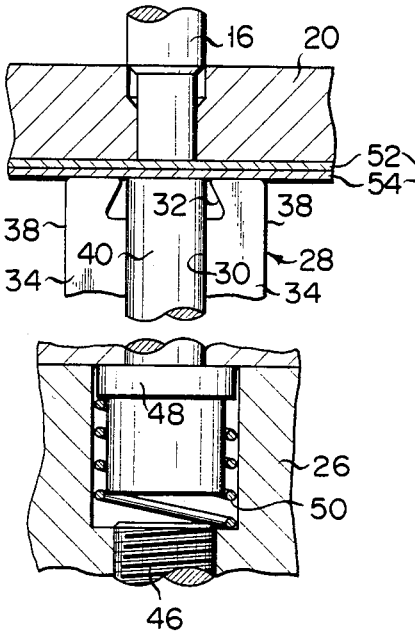
FIGS. 4 to 7 are sectional views showing processes according to an embodiment of the invention in due order.
Figure 5:
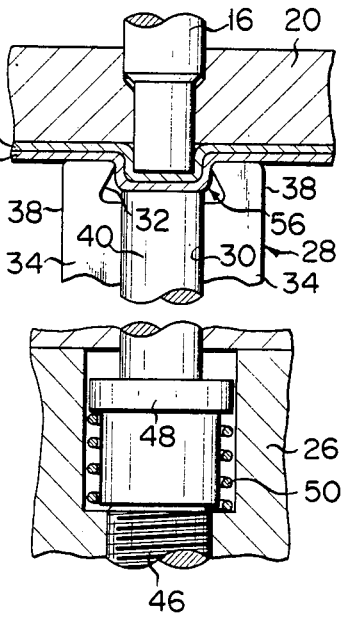

First, a plurality of or e.g. two metal plates 52 and 54 are placed in layers on the top end face of the die 28, as shown in FIG. 1, and then the ram 10 is lowered. When the ram 10 is lowered by a given distance, the presser plate 20 abuts against the metal plates 52 and 54 to press and fix them against and on the top end face of the die 28, as shown in FIG. 4. At the same time, the descent of the presser plate 20 is arrested. When the presser plate 20 is thus prevented from falling, only the punch 16 continues to be lowered by the ram 10, thereafter. Then, the metal plates 52 and 54 are drawn by the punch 16 to swell out substantially cylindrically into the tapered upper end portion 32 (hereinafter referred to as tapered portion) of the inner peripheral surface of the hole 42 of the die 28, as shown in FIG. 5.

Figure 6:
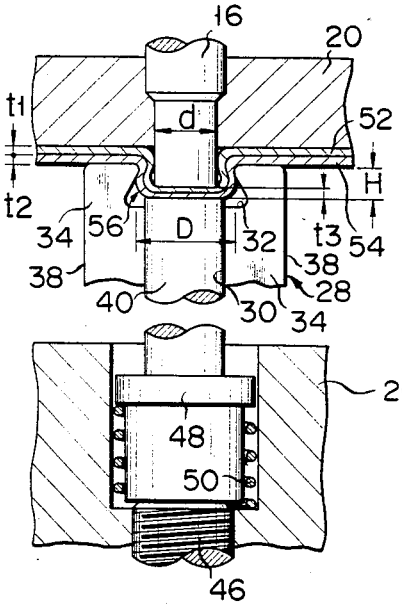

The base section 40 is pushed down against the elastic force of the compression coil spring 50 by a bottom wall 56 of the swollen or drawn part of the metal plates 52 and 54. The descent of the base section 40 is stopped when the bottom end face of the base section 40 touches the top end face of the screw 46, as shown in FIG. 5. At this situation, the top end face of the base section 40 is located near to the bottom face of the tapered portion 32. And the position of the base section 40 in the hole 30 at above described situation is called a second position. The punch 16 is lowered by a narrow distance even after the descent of the base section 40 is stopped. The bottom wall 56 of the drawn part of the metal plates 52 and 54 is extended by the scanty descent of the punch 16. As a result, the peripheral wall of the drawn part is brought into contact with the tapered portion 32 of the inner peripheral surface of the hole 30 of the die 28, so that the drawn part is formed into the shape of a flask having the bottom wall 56 and the peripheral wall tapered or reduced in diameter toward the top end face of the die 28, as shown in FIG. 6.

In this embodiment, the hole 30 of the die 28 is provided with the tapered portion 32, so that the bottom wall 56 of the drawn part of the metal plates 52 and 54 can be freely extended without any resistance. Since the peripheral wall of the drawn part is tapered, moreover, the jointing strength of the metal plates 52 and 54 can be increased.

Figure 7:
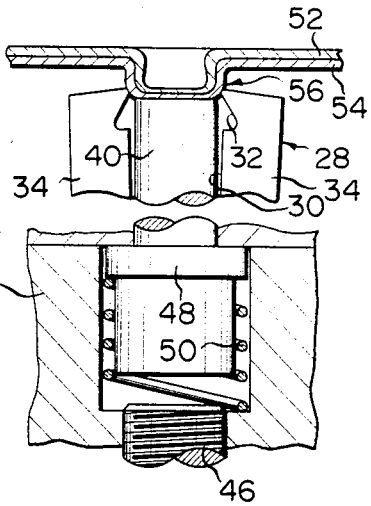

After the extension of the bottom wall 56 of the drawn part is finished, the ram 10 is raised. At this time, the punch 16 rises along with the presser plate 20 to return to its original position as shown in FIG. 1. At the same time, the base section 40 rises by the elastic force of the compression coil spring 50. The top end face of the rising base section 40 causes the drawn part of the metal plates 52 and 54 to rise. Since the four sections 38 of the die 28 are outwardly elastically spread along the radial direction by the peripheral wall of the rising drawn part, as shown in FIG. 7, the drawn part having the tapered peripheral wall can be removed from the tapered portion 32 of the hole 30 of the die 28. After the drawn part is removed from the tapered portion 32, the four sections 38 of the die 28 gather and are restored to the original state by their own elastic force.

An experiment conducted by the inventor hereof presented various conditions for jointing the two metal plates 52 and 54 together according to the embodiment described in detail hereinbefore. In this experiment, galvanized iron sheets of 0.5-mm thickness as provided for by JIS (Japanese Industrial Standard) G3302 SPGA were used. Each of those sheets has a thin film for painting which has a thickness of $17\mu$ to $30\mu$. As a result, it was revealed that the diameter D of the top end of the tapered portion 32 of the hole 30, as shown in FIG. 6, should preferably be 1.2 times as great as $\{d+2\times(t_1+t_2)\}$ or less. Further, the experiment told that the drawing depth H as shown in FIG. 6 should preferably be three times as great as $(t_1+t_2)$, and that the thickness $t_3$ of the drawn part of the metal plates 52 and 54 after extension should be 20% to 70% of $(t_1+t_2)$. Here d is the diameter of the punch 16, and $t_1$ and $t_2$ are the respective thicknesses of the two metal plates 52 and 54, as shown in FIG. 6. The experiment was conducted under various conditions; D=8 mm, d=6.9, 7.0, 7.1 and 7.2 mm, and H=0.9, 1.0, 1.1, 1.2, 1.3, 1.4, 1.5 and 1.6 mm. The drawn part of the two metal plates 52 and 54 was broken only when the condition H=1.6 mm was used.

According to this embodiment, as described above, the bottom wall of the drawn part is extended after drawing the two metal plates 52 and 54, so that the drawn part is formed into a tapered shape with the diameter of the bottom wall greater than that of the opening at the mouth of the die 28. The two metal plates 52 and 54 are coupled by means of the drawn part. Thus, the two metal plates 52 and 54 can be jointed together without forming any through holes for rivets or bolts, so that their mechanical strength at the joint portion will never be reduced. Since the through holes need not be formed in the metal plates 52 and 54, coating films, if any, on the metal plates 52 and 54 will not be damaged, and these metal plates can be used for containers which must be free from leakage of water or air.

Moreover, the apparatus used to effect the jointing method of the invention can be formed of the punch 16 and the die 28, and can outwardly separate the plurality of sections 38 of the die 28 from one another along the radial direction by only dividing the die 28 into these sections 38 by the plurality of splits 34. Thus, the apparatus can be manufactured at relatively low cost. In addition, the drawing process and the up-setting process for the two metal plates 52 and 54 can be achieved by a single descent of the punch 16, so that the time required for the execution of the method may be relatively short. This improves the efficiency of production of jointed combinations of plate materials out of a plurality of independent plate materials.

The two metal plates 52 and 54 can be jointed simultaneously at a plurality of portions thereof by using a plurality of pairs of punches 16 and dies 28 fixed to the punch frame 14 and the bolster 26, respectively.

Further, if the joint portion is one in number and if the shape of the bottom wall of the drawn part of the two metal plates 52 and 54 in plan view is exactly circular, the metal plates 52 and 54 can be rotated around the drawn part while they are kept parallel with each other.

As described above, the method for jointing plate materials according to this invention comprises a drawing process for drawing a plurality of overlapping plate materials by means of a punch and a die, and an up-setting process for extending a drawn part of the plate materials along the radial direction of the punch by means of the punch.

According to such method, the time required for jointing can be reduced without reducing the mechanical strength of the plate materials or damaging films on the materials and without limiting the kinds of applicable materials or requiring any special equipment, neither.

In the jointing method of the invention, the up-setting process preferably includes steps of dividing the die and separating several divided sections of the die from one another along the radial direction.

Thus, the up-setting process can be facilitated.

The apparatus used for the execution of the jointing method of the invention comprises a punch, a die having a die hole for drawing a plurality of overlapping materials in cooperation with the punch, the peripheral wall of the die hole consisting of a plurality of independent sections, a base section for extending a drawn part of the materials along the radial direction of the punch in cooperation with the punch, and separating means for separating the sections of the peripheral wall of the die hole from one another along the radial direction of the punch.

With such arrangement, the structure and operation of the apparatus can be simplified.

In the apparatus of the invention, the base section preferably includes a main body disposed inside the die hole and capable of moving along the central axis of the die hole between a first position at the inlet of the die hole and a second position in the vicinity of the bottom of the die hole where the materials are extended, and urging means for urging the main body toward the first position.

With such construction, the drawn part of the plate materials can be automatically removed from the die after the drawing and up-setting processes are finished, so that the time required for the execution of the jointing method can be reduced, and also the structure of a mechanism for such removal of the drawn part can be simplified.

In the apparatus of the invention, moreover, the die hole preferably increases in diameter from the inlet toward the bottom thereof.

With such construction, the plate materials can be jointed together with improved strength and reliability.

Although an illustrative embodiment of this invention has been described in detail herein, it is to be understood that the invention is not limited to such precise embodiment, and that various changes and modifications may be effected therein by one skilled in the art without departing from the scope or spirit of the invention.

For example, the force applied for the outward radial spreading and restoration of the sections 38 of the die 28 may be adjusted by means of an elastic member such as rubber or spring coupled to the outer periphery of the sections 38.

Figure 8:
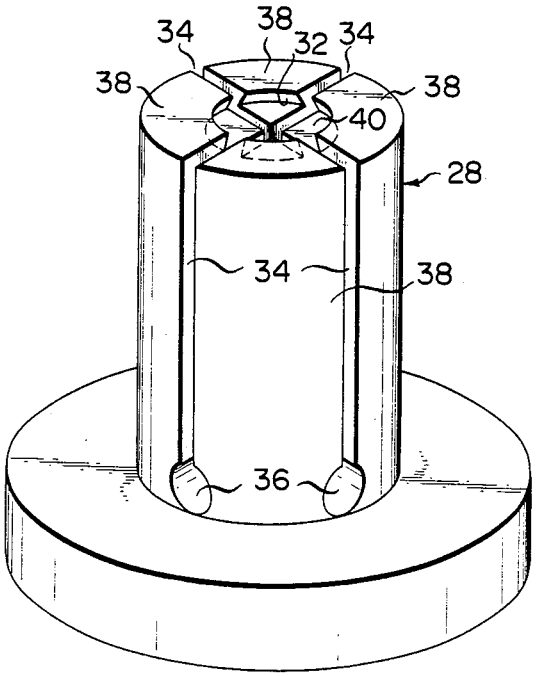
FIG. 8 is a perspective view of a die showing a modification of the die hole.

As shown in FIG. 8, moreover, the die hole 30 of the die 28 may be so designed that the base section 40 is formed of the bottom of the die hole 30. With such arrangement, the die 28 can be simplified in construction. In the modification of FIG. 8, an engaging strip (not shown) is inserted in the splits 34 so that it may abut on the bottom wall of the drawn part of the plate materials after completion of the up-setting process, and then the drawn part is removed from the die hole by means of the engaging strip.

Figure 9:
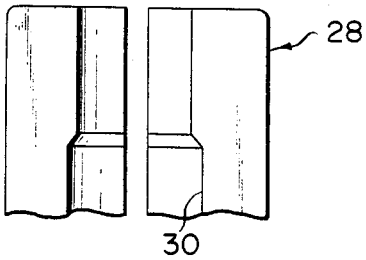
FIG. 9 is a front view showing another modification of the die hole as taken along the same plane as FIG. 3.

Furthermore, the upper end of the die hole 30 of the die 28 may be formed in the shape of a cylinder, as shown in FIG. 9. In this case, the bottom wall of the drawn part is extended on the top end face of the base section 40 against the elastic force of the sections 38 of the die 28.

What is claimed is:

1. An apparatus for jointing overlapping plate materials comprising:

a die having a top end surface, a base end surface, an axial die hole opened on said top end surface and including an inner peripheral surface slanting radially outwardly away from said top end surface, the axially inner end of said peripheral surface being located nearer to said top end surface than said base end surface, means defining a plurality of slits extending in the axial direction of said axial die hole from said top end surface to a point located nearer to said base end surface than the axially inner end of said peripheral surface of said die hole to permit separation of said die and said peripheral surface into a plurality of independent segments and to permit said segments to be radially outwardly elastically bendable around a base end portion which is adjacent to said base end surface of said die, and means defining a circular hole at the base end of each one of said slits to diffuse the stress concentrated at the base end of each one of said slits when the segments are radially outwardly elastically bent;

a base section member disposed inside said die hole and capable of moving along the central axis of said die hole between a first position wherein the top end surface of said base section member is located near and around the opening of said die hole and a second position wherein the top end surface of said base section member is located at the axially inner end of said peripheral surface of said die hole;

urging means for urging the base section member toward the first position thereof; and punch means reciprocally movable between a first position wherein said punch means is out of said die hole, and a second position wherein said punch means is inserted into said die hole against the urging force of said urging means for (i) pinching a portion of said overlapping plate materials between said punch means and said upper end surface of said base section member, (ii) drawing said portion of said overlapping plate materials said die hole, and (iii) extending said pinched portion of said overlapping plate materials along the radial direction of the die hole by pressing said pinched portion in conjunction with the upper end surface of said base section member when said base section member reaches its said second position, said punch means thereby forming a joint having a side wall conforming to said outwardly slanting peripheral surface of said die hole from the drawing portion of said overlapping plate materials; wherein said outwardly slanting peripheral surface of said die hole constitutes joint-discharge means for permitting said joint of said overlapping plate materials to be discharged from said die hole when said base section member is moved from its said second position to its said first position by the urging force of said urging means, said joint-discharge means for elastically bending said segments of said die radially outwardly in response to sliding contact between said conforming wall of said joint and said outwardly slanting peripheral surface of said die hole established during movement of said base section member from its said second position to its said first position whereby said joint is discharged from said die hole.

2. An apparatus for joining plate materials according to claim 1, wherein said axial die hole comprises a base surface which is formed integrally with the axial inner end of the peripheral surface of the die hole of the die so as to be flush with the top end surface of the base section member when the base section member is moved into its said second position.

* * * * *

UNITED STATES PATENT AND TRADEMARK OFFICE

CERTIFICATE OF CORRECTION

PATENT NO. : 4,569,111

DATED : Feb. 11, 1986

INVENTOR(S) : Yoshihiro MUTOU

It is certified that error appears in the above—identified patent and that said Letters Patent is hereby corrected as shown below:

On the title page

Change "[73] Assignee: Tokyo Shibaura Denki Kabushiki Kaisha, Japan" to --[73] Assignee: Tokyo Shibaura Denki Kabushiki Kaisha, Kawasaki, Japan--.

Signed and Sealed this

Ninth Day of December, 1986

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,569,111

DATED : Feb. 11, 1986

INVENTOR(S) : MUTOU, Yoshihiro

It is certified that error appears in the above-identified patent and that said Letters Patent is hereby corrected as shown below:

ON THE FIRST INFORMATION PAGE:

Change: "[30] Foreign Application Priority Data

Feb. 13, 1981 [JP] Japan .....55-16352" to

--[30] Foreign Application Priority Data

Feb. 13, 1980 [JP] Japan .....55-16352--.

Signed and Sealed this

Third Day of February, 1987

*Attest:*

*Attesting Officer*

DONALD J. QUIGG

*Commissioner of Patents and Trademarks*